US010358262B2

(12) United States Patent
Yokoyama et al.

(10) Patent No.: US 10,358,262 B2
(45) Date of Patent: Jul. 23, 2019

(54) SHAFT PACKAGING BODY

(71) Applicant: Mitsubishi Electric Corporation, Tokyo (JP)

(72) Inventors: Akihisa Yokoyama, Tokyo (JP); Yusaku Miyamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 475 days.

(21) Appl. No.: 15/029,662

(22) PCT Filed: Dec. 11, 2013

(86) PCT No.: PCT/JP2013/083194

§ 371 (c)(1),
(2) Date: Apr. 15, 2016

(87) PCT Pub. No.: WO2015/087410

PCT Pub. Date: Jun. 18, 2015

(65) Prior Publication Data

US 2016/0264296 A1 Sep. 15, 2016

(51) Int. Cl.
*B65D 25/04* (2006.01)
*B65D 25/10* (2006.01)
(Continued)

(52) U.S. Cl.
CPC ..... *B65D 25/04* (2013.01); *B65D 25/10* (2013.01); *B65D 85/20* (2013.01); *B65D 85/68* (2013.01); *B65D 2585/6877* (2013.01)

(58) Field of Classification Search
CPC ..... B65D 25/04; B65D 25/10; B65D 2585/6877; B65D 85/20; B65D 85/68
(Continued)

(56) References Cited

U.S. PATENT DOCUMENTS 5,415,289 A * 5/1995 Kim ..... B65D 71/0096 206/386
6,050,419 A * 4/2000 Flanagan ..... B65D 71/0096 206/597
(Continued)

FOREIGN PATENT DOCUMENTS

CN 1927664 A 3/2007
GB 907038 A 10/1962
(Continued)

OTHER PUBLICATIONS

International Search Report of the International Searching Authority dated Mar. 18, 2014 for the corresponding international application No. PCT/JP2013/083194 (and English translation).
(Continued)

*Primary Examiner* — James N Smalley
*Assistant Examiner* — Madison L Poos
(74) *Attorney, Agent, or Firm* — Posz Law Group, PLC

(57) ABSTRACT

A shaft packaging body includes packaging material having: a partitioning frame forming a space for accommodating a shaft; a first lower side support member including a first lower notch conforming to a small-diameter side of a step between a center portion and one end portion of the shaft; a second lower side support member including a second lower notch conforming to a small-diameter side of a step between the center portion and another end portion of the shaft; a first upper side support member including a first upper notch conforming to the small-diameter side of the step between the center portion and the one end portion of the shaft; and a second upper side support member including a second upper notch conforming to the small-diameter side of the step between the center portion and the other end portion of the shaft.

4 Claims, 6 Drawing Sheets

(51) Int. Cl.
*B65D 85/20* (2006.01)
*B65D 85/68* (2006.01)

(58) Field of Classification Search
USPC ..... 206/443, 446; 220/552
See application file for complete search history.

(56) References Cited

U.S. PATENT DOCUMENTS

| | | | | |
|---|---|---|---|---|
| 6,098,803 | A | 8/2000 | Tanaka et al. | |
| 8,294,030 | B2 * | 10/2012 | Pollard, Jr. ..... | H02G 3/30 174/155 |

FOREIGN PATENT DOCUMENTS

| | | | |
|---|---|---|---|
| JP | 06-040486 | A | 2/1994 |
| JP | 06-022270 | U | 3/1994 |
| JP | 09-301434 | A | 11/1997 |
| JP | 11-029136 | A | 2/1999 |
| JP | 11-152107 | A | 6/1999 |
| JP | 11-236045 | A | 8/1999 |
| JP | 2000-238883 | A | 9/2000 |
| JP | 2001-063763 | A | 3/2001 |
| JP | 2003-312648 | A | 11/2003 |
| JP | 4420257 | B1 | 12/2009 |
| JP | 2011-098755 | A | 5/2011 |
| WO | 2001/008997 | A1 | 2/2001 |

OTHER PUBLICATIONS

Office Action dated Feb. 4, 2017 in the corresponding CN patent application No. 201380081262.9. (with partial English translation).
International Preliminary Report on Patentability dated Jun. 23, 2016 in the corresponding International application No. PCT/JP2013/083194.

* cited by examiner

SHAFT PACKAGING BODY

CROSS REFERENCE TO RELATED APPLICATION

This application is a U.S. national stage application of International Application No. PCT/JP2013/083194 filed on Dec. 11, 2013, the disclosure of which is incorporated herein by reference.

TECHNICAL FIELD

The present invention relates to a shaft packaging body.

BACKGROUND ART

Patent Literature 1 describes a packaging body for an outboard motor. The packaging body includes a pair of pads. The pads press an outboard motor from above and below. As a result, movement of the outboard motor is suppressed.

CITATION LIST

Patent Literature

Patent Literature 1: Japanese Patent Laid-Open No. 2001-63763

Patent Literature 2: Japanese Utility Model Laid-Open No, 06-22270

Patent Literature 3: Japanese Patent Laid-Open No. 11-152107

Patent Literature 4: Japanese Patent No. 4420257

Patent Literature 5: Japanese Patent Laid-Open No. 2011-98755

Patent Literature 6: Japanese Patent Laid-Open No. 2003-312648

SUMMARY OF INVENTION

Technical Problem

However, the force of the packaging body holding the outboard motor is poor in the axial direction. Therefore, employment of the packaging body to package shafts results in the shafts easily movement in an axial direction.

The present invention has been made to solve the aforementioned problem. An object of the present invention is to provide a shaft packaging body enabling suppression of axial movement of a shaft.

Means for Solving the Problems

A shaft packaging body of the invention has a partitioning frame forming a space that accommodates a shaft including one end portion and another end portion each having a diameter that is different from that of a center portion; a first lower support member fitted in a lower portion of the partitioning frame, the first lower support member including a first lower notch formed so as to, when the shaft is accommodated in the space of the partitioning frame, conform to a diameter of a small-diameter side of a step between the center portion and the one end portion of the shaft on a lower side of the small-diameter side of the step; a second lower support member fitted in the lower portion of the partitioning frame, the second lower support member including a second lower notch formed so as to, when the shaft is accommodated in the space of the partitioning frame, conform to a diameter of a small-diameter side of a step between the center portion and the other end portion of the shaft on a lower side of the small-diameter side of the step; a first upper support member fitted in an upper portion of the partitioning frame, the first upper support member including a first upper notch formed so as to, when the shaft is accommodated in the space of the partitioning frame, conform to the diameter of the small-diameter side of the step between the center portion and the one end portion of the shaft on an upper side of the small-diameter side of the step; and a second upper support member fitted in the upper portion of the partitioning frame, the second upper support member including a second upper notch formed so as to, when the shaft is accommodated in the space of the partitioning frame, conform to the diameter of the small-diameter side of the step between the center portion and the other end portion of the shaft on an upper side of the small-diameter side of the step.

Advantageous Effects of Invention

According to the present invention, support members support a shaft via respective notches formed so as to conform to respective diameters of the small-diameter sides of two steps of the shaft on the respective small-diameter sides of the steps. Therefore; axial movement of the shaft can be suppressed.

DESCRIPTION OF EMBODIMENTS

Figure 1:
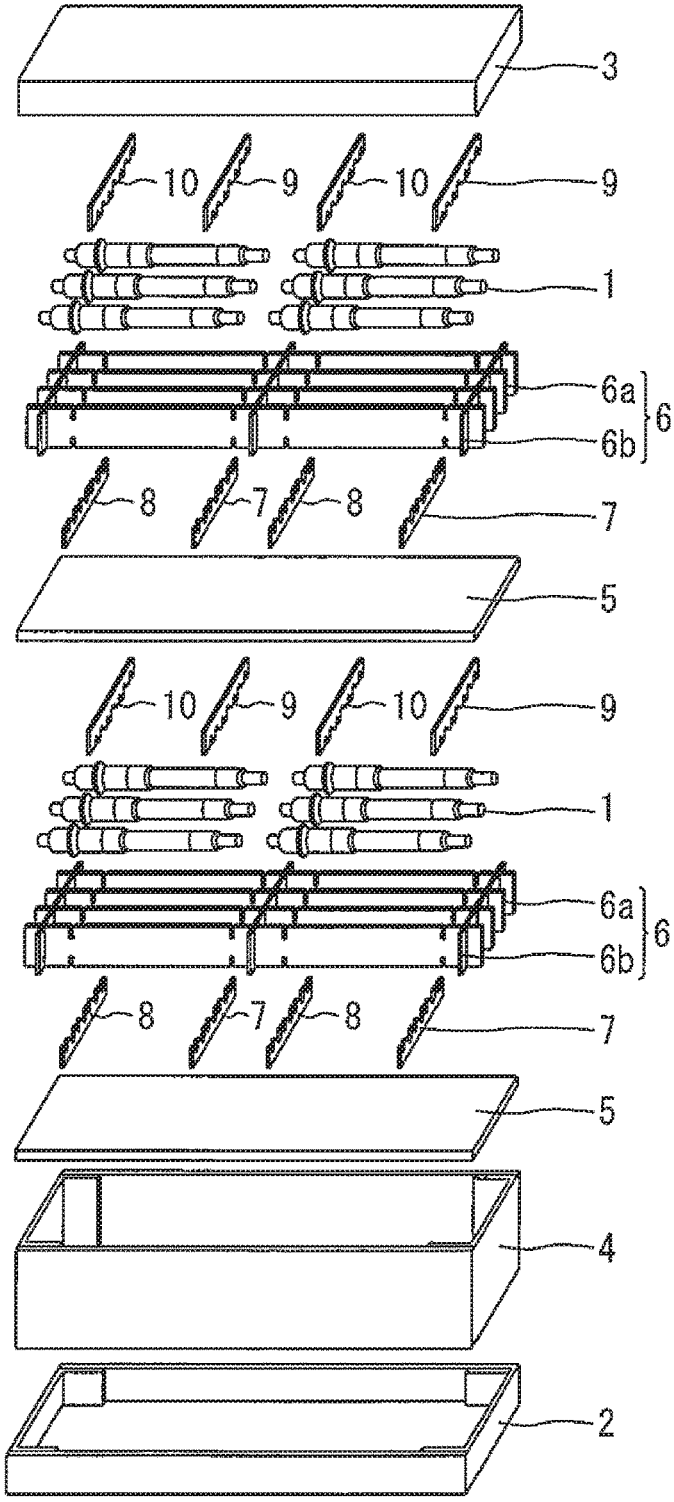
FIG. 1 is an exploded perspective view of a shaft packaging body according to Embodiment 1 of the present invention.

Embodiments of the present invention will be described with reference to the attached drawings. In the drawings, parts that are identical or correspond to each other are provided with a same reference numeral, Overlapping descriptions thereof will arbitrarily be simplified or omitted.

Embodiment 1

FIG. 1 is an exploded perspective view of a shaft packaging body according to Embodiment 1 of the present invention.

In FIG. 1, each of shafts 1 is a part having a shape formed by combining a plurality of cylindrical portions. A diameter of a center portion of each shaft 1 is different from that of each of opposite end portions of the shaft 1. For example, the diameter of the center portion of each shaft 1 is larger than that of an end portion of the shaft 1. For example, the diameter of the center portion of each shaft 1 is larger than that of another end portion of the shaft 1. For example, two shafts 1 are arranged side by side in a horizontal direction. For example, three shafts 1 are arranged side by side in an axial direction. For example, the shafts 1 are arranged in two tiers.

The packaging body includes a lower packaging material 2, an upper packaging material 3, an exterior material 4, a plurality of sheet materials 5, a plurality of partitioning frames 6, a plurality of first lower support members 7, a plurality of second lower support members 8, a plurality of first upper support members 9 and a plurality of second upper support members 10.

The lower packaging material 2 is formed by bending a paperboard material such as a cardboard sheet. The upper packaging material 3 is formed by bending a paperboard material such as a cardboard sheet. The exterior material 4 is formed in a tubular shape by bending a paperboard material such as a cardboard sheet. Each of the plurality of sheet materials 5 is formed in a rectangular shape using a paperboard material such as a cardboard sheet.

Each of the plurality of partitioning frames 6 includes a plurality of first sheet materials 6*a* and a plurality of second sheet materials 6*b*. Each of the plurality of first sheet materials 6*a* and each of the plurality of second sheet materials 6*b* are each formed in a rectangular shape using a paperboard material such as a cardboard sheet.

Each of the plurality of first lower support members 7, each of the plurality of second lower support members 8, each of the plurality of first upper support members 9 and each of the plurality of second upper support members 10 have a same shape. Each of the plurality of first low support members 7, each of the plurality of second lower support members 8, each of the plurality of first upper support members 9 and each of the plurality of second upper support members 10 are each formed in a rectangular shape using a paperboard material such as a cardboard sheet.

In packaging of shafts 1, the exterior material 4 is put on the upper side of the lower packaging material 2. Subsequently, a first-tier sheet material 5 is put on the upper side of the lower packaging material 2 inside the exterior material 4, Subsequently, first-tier first lower support members 7 and first-tier second lower support members 8 are put in a first-tier partitioning frame 6. Subsequently, the first-tier partitioning frame 6, the first-tier first lower support members 7 and the first-tier second lower support members 8 are put on the upper side of the first-tier sheet material 5 inside the exterior material 4.

Subsequently, respective first-tier shafts 1 are accommodated in respective spaces formed by the first-tier partitioning frame 6 on the upper side of the first-tier first lower support members 7 and the first-tier second lower support members 8. Subsequently, first-tier first upper support members 9 and first-tier second upper support members 10 are put in the first-tier partitioning frame 6 on the upper side of the first-tier shafts 1.

Subsequently, a second-tier sheet material 5 is put on the upper side of the first-tier partitioning frame 6 inside the exterior material 4. Subsequently, second-tier first lower support members 7 and second-tier second lower support members 8 are put in a second-tier partitioning frame 6, Subsequently, the second-tier partitioning frame 6, the second-tier first lower support members 7 and the second-tier second lower support members 8 put on the upper side of the second-tier sheet material 5 inside the exterior material 4.

Subsequently, respective second-tier shafts 1 are accommodated in respective spaces formed by the second-tier partitioning frame 6 on the upper side of the second-tier first lower support members 7 and the second-tier second lower support members 8. Subsequently, second-tier first support members 9 and second-tier second upper support members 10 are put in the second-tier partitioning frame 6 on the upper side of the second-tier shafts 1. Subsequently, the upper packaging material 3 is put in the upper side of the second-tier first upper support members 9 and the second-tier second upper support members 10.

Next, a completely-assembled state of the packaging body will be described with reference to FIG. 2.

Figure 2:
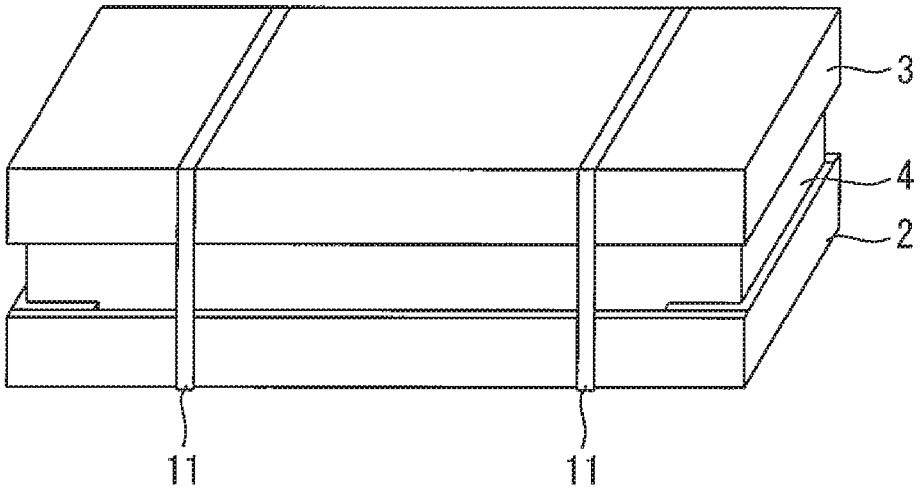
FIG. 2 is a complete assembly diagram of the shaft packaging body according to Embodiment 1 of the present invention.

FIG. 2 is a complete assembly diagram of the shaft packaging body according to Embodiment 1 of the present invention.

In FIG. 2, the plurality of shafts 1, the plurality of sheet materials 5, the plurality of partitioning frames 6, the plurality of first lower support members 7, the plurality of second lower support members 8, the plurality of first upper support members 9 and the plurality of second upper support members 10 are not visible. In other words, the packaging body covers the plurality of shafts 1, etc. More specifically, the lower packaging material 2 covers the plurality of shafts 1, etc. from below. The upper packaging material 3 covers the plurality of shafts 1, etc., from above. The exterior material 4 covers the plurality of shafts 1 from the sides. A plurality of bands 11 are wound around the packaging body so as to fasten the lower packaging material 2 and the upper packaging material 3. As a result, the packaging body is maintained in a state in which the packaging body accommodates the plurality of shafts 1.

Next, assembling of a partitioning frame 6, attachment of first lower support members 7 and attachment of second lower support members 8 will be described with reference to FIG. 3.

Figure 3:
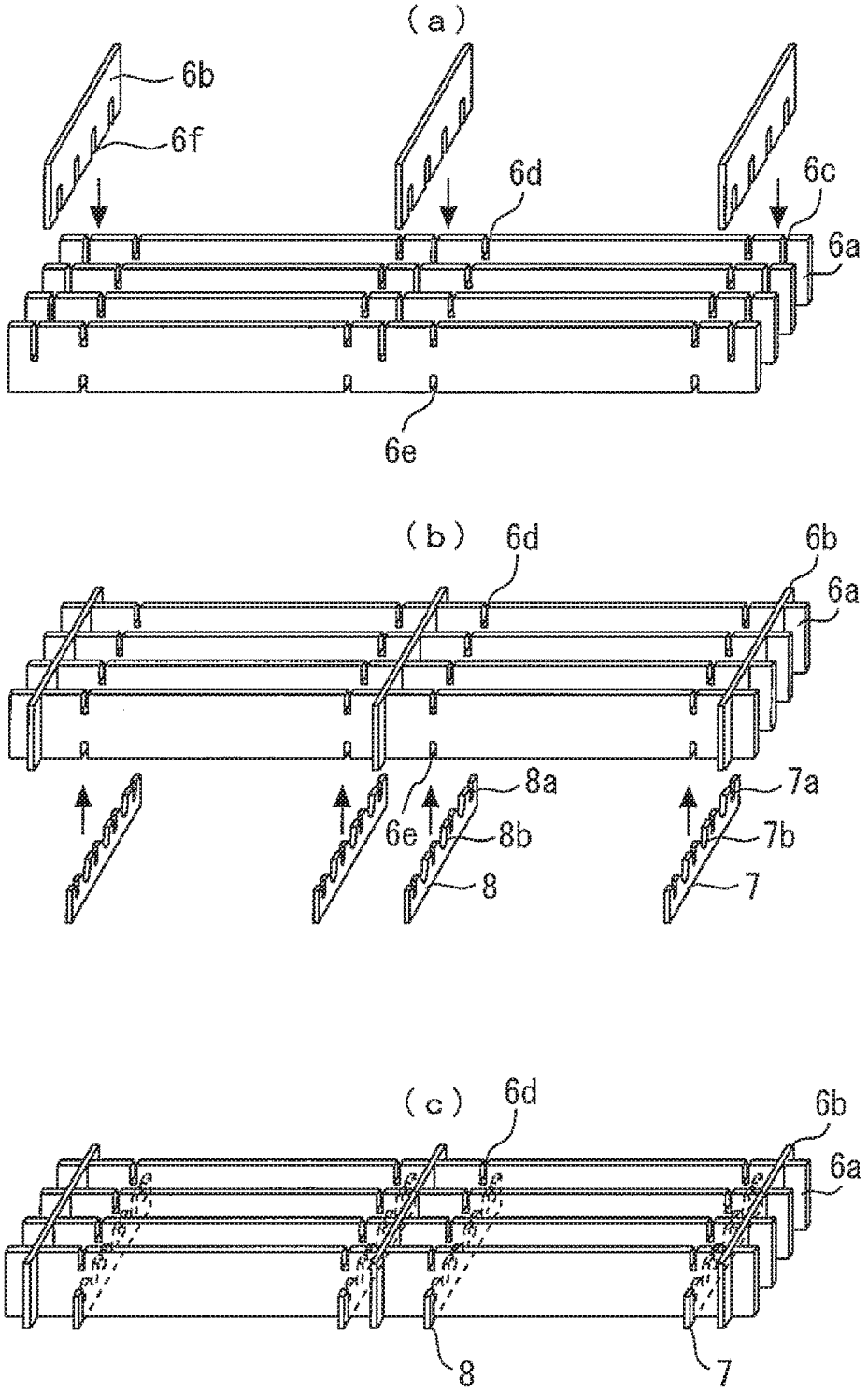
FIG. 3 is a detailed assembly diagram of the shaft packaging body according to Embodiment 1 of the present invention.

FIG. 3 is a detailed assembly diagram of the shaft packaging body according to Embodiment 1 of the present invention.

As illustrated in FIG. 3, a plurality of notches 6*c* are formed in an upper portion of each first sheet material 6*a*. Each of the plurality of notches 6*c* is formed in a rectangular shape. A plurality of notches 6*d* are formed in the upper portion of each first sheet material 6*a*. The plurality of notches 6*d* are formed so as to be paired across the respective adjacent notches 6*c*. Each of the plurality of notches 6*d* is formed in a rectangular shape. A plurality of notches 6*e* are formed in a lower portion of each first sheet material 6*a*. The plurality of notches 6*e* are formed so as to b paired across the respective adjacent notches 6*c*. Each of the plurality of notches 6*e* is formed in a rectangular shape.

A plurality of notches 6*f* are formed in a lower portion of each second sheet material 6*b*. As the plurality of notches 6*f*, a preset number of notches 6*f* are formed.

As the plurality of first sheet materials 6*a*, a preset number of first sheet materials 6*a* are arranged. As the plurality of second sheet materials 6*b*, a number of second sheet materials 6*b*, the number corresponding to the number of notches 6*c* formed in each first sheet material 6*a*, are arranged. The plurality of second sheet materials 6*b* are arranged on the upper side of the plurality of first sheet materials 6*a* so as to be perpendicular to the plurality of first sheet materials 6*a*. As a result, the respective notches 6*f* of the plurality of second sheet material 6*b* are disposed on the upper sides of the respective notches 6*c* of the plurality of first sheet materials 6*a*. Subsequently, the respective notches 6*f* of the plurality of second sheet materials 6*b* are fitted to the respective notches 6*c* of the plurality of first sheet materials 6*a*. As a result, assembling of the partitioning frame 6 is completed.

A plurality of notches 7*a* are formed in an upper portion of each first lower support member 7. Each of the plurality of notches 7*a* is formed in a rectangular shape. A plurality of first lower notches 7*b* are formed in the upper portion of each first lower support member 7. Each of the plurality of first lower notches 7*b* is formed between adjacent notches 7*a*, Each of the plurality of first lower notches 7*b* is formed in a semicircular shape.

A plurality of notches 8*a* are formed in an upper portion of each second lower support member 8. Each of the plurality of notches 8*a* is formed in a rectangular shape. A plurality of second lower notches 8*b* are formed in the upper portion of each second lower support member 8. Each of the plurality of second lower notches 8*b* is formed between adjacent notches 8*a*. Each of the plurality of second lower notches 8*b* is formed in a semicircular shape.

The plurality of first lower support members 7 are arranged in alignment with ones of the paired notches 6*e*. The plurality of first lower support members 7 are arranged on the lower side of the plurality of first sheet materials 6*a* so as to be perpendicular to the plurality of first sheet materials 6*a*. As a result, each of the notches 7*a* of the plurality of first lower support members 7 is disposed on the lower side of the one of the corresponding paired notches 6*e*. Subsequently, each of the notches 7*a* of the plurality of first lower support members 7 is fitted to the one of the corresponding paired notches 6*e*. As a result, the plurality of first lower support members 7 are attached to the partitioning frame 6.

The plurality of second lower support members 8 are arranged in alignment with the others of the paired notches 6*e*. The plurality of second lower support members 8 are arranged on the lower side of the plurality of first sheet materials 6*a* so as to be perpendicular to the plurality of first sheet materials 6*a*. As a result, each of the notches 8*a* of the plurality of second lower support members 8 is disposed on the lower side of the other of the corresponding paired notches 6*e*. Subsequently, each of the notches 8*a* of the plurality of second lower support members 8 is fitted to the other of the corresponding paired notches 6*e*. As a result, the plurality of second lower support members 8 are attached to the partitioning frame 6.

Next, supporting of the shafts 1, attachment of the first upper support members 9 and attachment of the second upper support members 10 will be described with reference to FIG. 4.

Figure 4:
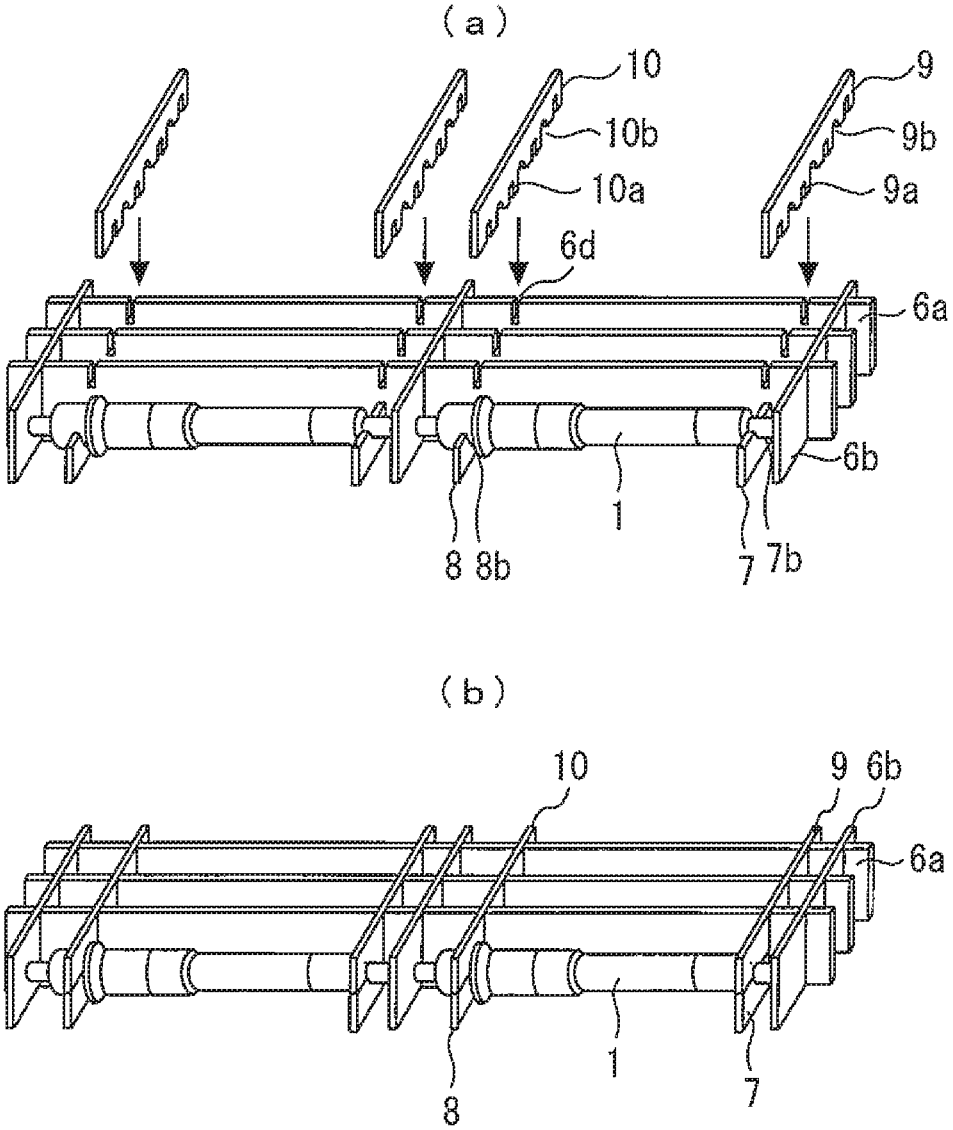
FIG. 4 is a detailed assembly diagram of a shaft packaging body according to Embodiment 1 of the present invention.

FIG. 4 is a detailed assembly diagram of a shaft packaging body according to Embodiment 1 of the present invention. In FIG. 4, the frontmost first sheet material 6*a* is not illustrated.

One side of each of the plurality of shafts 1 is placed on first lower notch 7*b* of the corresponding first lower support member 7. Here, the first lower notch 7*b* supports the one end portion side of the shaft 1 at a step between the center portion and the one end portion of the shaft 1.

The other side of each of the plurality of shafts 1 is placed on a second lower notch 8*b* of the corresponding second lower support member 8. Here, the second lower notch 8*b* supports the one end portion side of the shaft 1 at a step between the center portion and the one end portion of the shaft 1.

The first upper support members 9 are disposed so as to be vertical reversals of the first lower support members 7. A plurality of notches 9*a* are formed in a lower portion of each of the first upper support members 9. Each of the plurality of notches 9*a* is formed in a rectangular shape. A plurality of first upper notches 9*b* are formed in the lower portion of each of the first upper support members 9. Each of the plurality of first upper notches 9*b* is formed between adjacent notches 9*a*. Each of the plurality of first upper notches 9*b* is formed in a semicircular shape.

The second upper support members 10 are disposed so as to be vertical reversals of the second low support members 8. A plurality of notches 10*a* are formed in the lower portion of each of the second upper support members 10. Each of the plurality of notches 10*a* is formed in a rectangular shape. A plurality of second upper notches 10*b* are formed in the lower portion of each of the second upper support members 10. Each of the plurality of second upper notches 10*b* is formed between adjacent notches 10*a*. Each of the plurality of second upper notches 10*b* is formed in a semicircular shape.

The plurality of first upper support members 9 are arranged in alignment with ones of the paired notches 6*d*. The plurality of first upper support members 9 are arranged on the upper side of the plurality of first sheet materials 6*a* so as to be perpendicular to the plurality of first sheet materials 6*a*. As a result, each of the notches 9*a* of the plurality of first upper support members 9 is disposed on the upper side of the one of the corresponding paired notches 6*d*. Subsequently, each of the notches 9*a* of the plurality of first upper support members 9 is fitted to the one of the corresponding paired notches 6*d*. As a result, the respective end portions of the plurality of shafts 1 are held between the respective first lower notches 7*b* and the respective first upper notches 9*b*.

The plurality of second upper support members 10 are arranged in alignment with the others of the paired notches 6*d*. The plurality of second upper support members 10 are arranged on the upper side of the plurality of first sheet materials 6*a* so as to be perpendicular to the plurality of first sheet materials 6*a*. As a result, each of the notches 10*a* of the plurality of second upper support members 10 is disposed on the upper side of the other of the corresponding paired notches 6*d*. Subsequently, each of the notches 10*a* of the plurality of second upper support members 10 is fitted to the other of the corresponding paired notches 6*d*. As a result, the respective other end portions of the plurality of shafts 1 are held between the respective second lower notches 8*b* and the respective second upper notches 10*b*.

According to Embodiment 1 described above, the one end portions of the shafts 1 are held between the first lower support members 7 and the first upper support members 9. The other end portions of the shafts 1 are held between the second lower support members 8 and the second upper support members 10. Here, the first lower notches 7*b* and the first upper notches 9*b* are disposed on the small-diameter sides of the respective steps of the shafts 1. The second lower notches 8*b* and the second upper notches 10*b* are disposed on the small-diameter sides of the respective steps of the shafts 1. Thus, vertical, horizontal and axial movement of the shafts 1 is suppressed. As a result, the shafts 1 can be prevented from being damaged in transit.

Also, a load generated when shafts 1 are stacked in tiers in, e.g., a warehouse is borne by the exterior material 4, the partitioning frames 6, the first lower support members 7, the second lower support members 8, the first upper support members 9 and the second upper support members 10. Thus, the shafts 1 can be packaged with a sufficient pressure capacity provided.

Also, the packaging body is formed using paperboards such as cardboard sheets, except the bands 11. Thus, the packaging body is excellent in environmental aspects. In other words, the packaging body does not require separation at the time of disposal and thus excellent in disposability.

In the packaging body, the number of shafts 1 to be accommodated in one tier and the number of tiers that accommodate shafts 1 may arbitrarily be set. In this case, also, the shafts 1 can be prevented from being damaged in transit.

Embodiment 2

Figure 5:
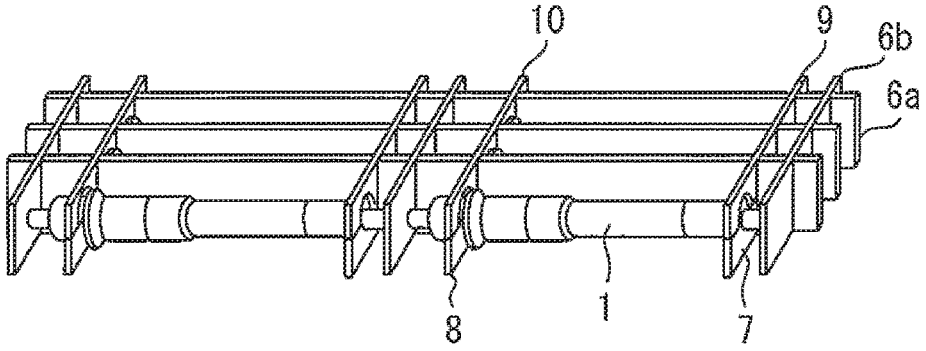
FIG. 5 is a detailed assembly diagram of a shaft packaging body according to Embodiment 2 of the present invention.

FIG. 5 is a detailed assembly diagram of a shaft packaging body according to Embodiment 2 of the present invention. Here, parts that are identical or correspond to those of Embodiment 1 are provided with reference numerals that are the same as those of Embodiment 1 and description thereof will be omitted.

In Embodiment 1, each of the plurality of first lower support members 7, each of the plurality of second lower support members 8, each of the plurality of first upper support members 9 and each of the plurality of second upper support members 10 have a same shape. On the other hand, in Embodiment 2, each of a plurality of first lower support members 7 and each of a plurality of second lower support members 8 have a shape that is different from that of each of a plurality of first upper support members 9 and each of a plurality of second upper support members 10.

Next, the first upper support members 9 will be described with reference to FIG. 6.

Figure 6:
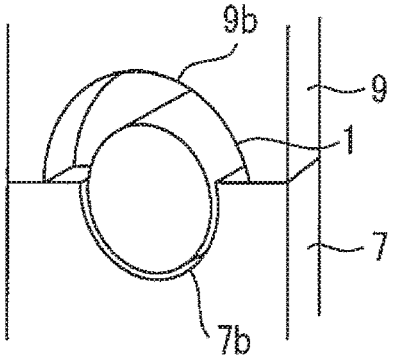
FIG. 6 is an enlarged major part view of a shaft packaging body according to Embodiment 2 of the present invention.

FIG. 6 is an enlarged major part view of a shaft packaging body according to Embodiment 2 of the present invention.

As illustrated in FIG. 6, a diameter of a first upper notch 9*b* of each first upper support member 9 is larger than that of a first lower notch 7*b* of each first lower support member 7. Thus, a gap is formed between each first upper notch 9*b* of the first upper support member 9 and one end portion of a relevant shaft 1.

Although not illustrated, a diameter of a second upper notch 10*b* of each second upper support member 10 is larger than that of a second lower notch 8*b* of each second lower support member 8. Thus, a gap is formed between each second lower notch 8*b* of the second lower support member 8 and another end portion of a relevant shaft 1.

According to Embodiment 2 described above, the diameter of the first upper notches 9*b* is larger than that of the first lower notches 7*b*. Thus, a gap is formed between each first upper notch 9*b* and the one end portion of the relevant shaft 1. In this case, no compressive load is imposed on the one end portions of the shafts 1. As a result, deformation of the one end portions of the shafts 1 due to compressive load can reliably be prevented.

Also, the diameter of the second upper notches 10*b* is larger than that of the second lower notches 8*b*. Thus, a gap is formed between each second upper notch 10*b* and the other end portion of the relevant shaft 1. In this case, no compressive load is imposed on the other end portions of the shafts 1. As a result, deformation of the other end portions of the shafts 1 due to compressive load can reliably be prevented.

Here, as in Embodiment 1, fixation of the shafts 1 is maintained by the first lower support members 7 and the second lower support members 8.

Embodiment 3

Figure 7:
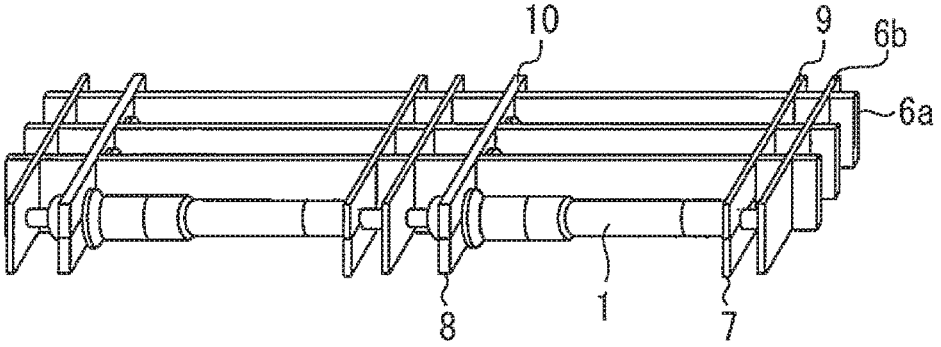
FIG. 7 is a detailed assembly diagram of a shaft packaging body according to Embodiment 3 of the present invention.

FIG. 7 is a detailed assembly diagram of a shaft packaging body according to Embodiment 3 of the present invention. Here, parts that are identical or correspond to those of Embodiment 1 are provided with reference numerals that are the same as those of Embodiment 1 and description thereof will be omitted.

In Embodiment 1, a thickness of the first lower support members 7 is equal to that of the second lower support members 8. A thickness of the first upper support members 9 is equal to that of the second upper support members 10. On the other hand, in Embodiment 3, a thickness of first lower support members 7 is different from that of second lower support members 8. A thickness of first upper support members 9 is different from that of second upper support members 10.

More specifically, the second lower support members 8 are thicker than the first lower support members 7. The second upper support members 10 are thicker than the first upper support members 9. The second lower support members 8 and the second upper support members 10 support respective shafts 1 at respective steps closer to respective gravity centers of the shafts 1.

According to Embodiment 3 described above, the second lower support members 8 are thicker than the first lower support members 7. The second upper support members 10 are thicker than the first upper support members 9. As a result, a strength of the second low support members 8 and a strength of the second upper support members 10 can be enhanced. In this case, neither the second lower support members 8 nor the second upper support members 10 collapse even if a large load is imposed thereon. Thus, the shafts 1 can be packaged with a sufficient pressure capability more reliably provided.

Also, the thickness of the first lower support members 7 is different from that of the second lower support members 8. Thus, a packaging worker can easily distinguish between the first lower support members 7 and the second lower support members 8. Furthermore, the thickness of the first upper support members 9 is different from that of the second upper support members 10. Thus, the packaging worker can easily distinguish between the first upper support members 9 and the second upper support members 10. As a result, packaging workability can be improved.

Here, the thickness of at least one of each first lower support member 7, each second lower support member 8, each first upper support member 9 and each second upper support member 10 may be made to be different from that of the other support members. In this case, also, the packaging workability can be improved to a certain degree.

Embodiment 4

Figure 8:
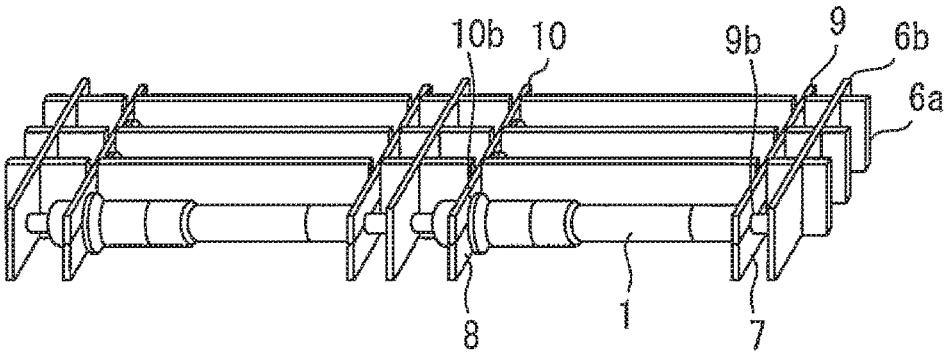
FIG. 8 is a detailed assembly diagram of a shaft packaging body according to Embodiment 4 of the present invention.

FIG. 8 is a detailed assembly diagram of a shaft packaging body according to Embodiment 4 of the present invention. Here, parts that are identical or correspond to those of Embodiment 1 are provided with reference numerals that are the same as those of Embodiment 1 and description thereof will be omitted.

In Embodiment 1, a height of the first lower support members 7 is equal to that of the first upper support members 9. A height of the second lower supports member 8 is equal to that of the second upper support members 10. On the other hand, in Embodiment 4, a height of first lower support members 7 is different from a height of first upper support members 9. A height of second lower support members 8 is different from a height of second upper support members 10.

More specifically, the first upper support members 9 are lower than the first lower support members 7. As a result, the first upper support members 9 are inserted to respective positions below an upper surface of a partitioning frame 6. The second upper support members 10 are lower than the second lower support members 8. As a result, the second upper support members 10 are inserted to respective positions below the upper surface of the partitioning frame 6.

According to Embodiment 4 described above, the first upper support members 9 and the second upper support members 10 are inserted to the respective positions below the upper surface of the partitioning frame 6. Thus, when shafts 1 are packaged, a compressive load is imposed on the partitioning frame 6. In other words, the compressive load is not imposed on the first upper support members 9 and the second upper support members 10. Thus, deformation of the shafts 1 due to compressive load can more reliably be prevented.

Here, an end portion of each first upper notch 9*b* is in contact with an outer periphery of one end portion of the relevant shaft 1 with no gap therebetween. An end portion of each second upper notch 10*b* is in contact with an outer periphery of another end portion of the relevant shaft 1 with no gap therebetween. Thus, fixation of the shafts 1 is maintained.

Embodiment 5

Figure 9:
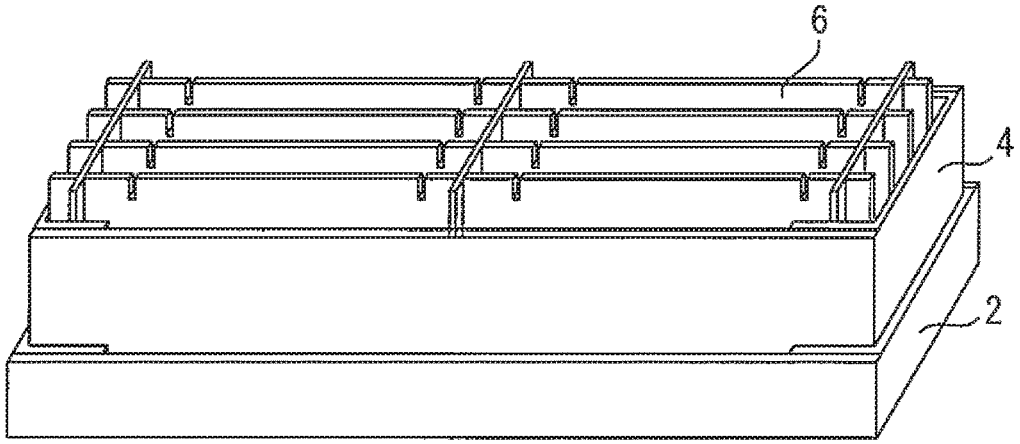
FIG. 9 is a detailed assembly diagram of a shaft packaging material according to Embodiment 5 of the present invention.

FIG. 9 is a detailed assembly diagram of a shaft packaging material according to Embodiment 5 of the present invention. Here, parts that are identical or correspond to those of Embodiment 1 are provided with reference numerals that are the same as those of Embodiment 1 and description thereof will be omitted.

In Embodiment 1, a height of the exterior material 4 is equal to a total of respective heights of the plurality of sheet materials 5 and respective heights of the plurality of partitioning frames 6. On the other hand, in Embodiment 5, a height of an exterior material 4 is smaller than a total of respective heights of a plurality of sheet materials 5 and respective heights of a plurality of partitioning frames 6.

According to Embodiment 5 described above, the height of the exterior material 4 is smaller than the total of the respective heights of the plurality of sheet materials 5 and the respective heights of the plurality of partitioning frames 6. Here, a compressive load is imposed on the plurality of sheet materials 5 and the plurality of partitioning frames 6. In other words, the compressive load is not imposed on the exterior material 4. In this case, the exterior material 4 is prevented from expanding outward. As a result, the packaging body can be stored with no damage to an outer appearance of the packaging body.

INDUSTRIAL APPLICABILITY

As described above, a shaft packaging body according to the present invention can be used for a system that packages stepped shafts.

DESCRIPTION OF SYMBOLS

1 shaft, 2 lower packaging material, 3 upper packaging material, 4 exterior material, sheet material, 6 partitioning frame, 6*a* first sheet material, 6*b* second sheet material, 6*c* notch, 6*d* notch, 6*e* notch, 7 first lower support member, 7*a* notch, 7*b* first lower notch, 8 second lower support member, 8*a* notch, 8*b* second lower notch, 9 first upper support member, 9*a* notch, 9*b* first upper notch, 10 second upper support member, 10*a* notch, 10*b* second upper notch, 11 band

The invention claimed is:

1. A shaft packaging body comprising:

a partitioning frame forming a space accommodating a shaft including one cylindrical end portion and another cylindrical end portion each having a diameter that is different from that of a cylindrical center portion;

a first lower support member fitted in a lower portion of the partitioning frame, the first lower support member having a first lower notch formed in a semicircular shape to, when the shaft is accommodated in the space of the partitioning frame, conform to a diameter of a small-diameter one of the center portion and the one end portion of the shaft on a lower side of the small-diameter one;

a second lower support member fitted in the lower portion of the partitioning frame, the second lower support member having a second lower notch formed in a semicircular shape to, when the shaft is accommodated in the space of the partitioning frame, conform to a diameter of a small-diameter one of the center portion and the other end portion of the shaft on a lower side of the small-diameter one;

a first upper support member fitted in an upper portion of the partitioning frame in contact with the first lower support member in a vertical direction, the first upper support member having a first upper notch formed in a semicircular shape so as to, when the shaft is accommodated in the space of the partitioning frame, form a gap between the first upper notch and the small-diameter one of the center portion and the one end portion of the shaft on an upper side of the small-diameter one, the first upper notch having a diameter larger than that of the small-diameter one, so that the first upper support member does not contact the small-diameter one; and a second upper support member fitted in the upper portion of the partitioning frame in contact with the second lower support member in the vertical direction, the second upper support member having a second upper notch formed in a semicircular shape to, when the shaft is accommodated in the space of the partitioning frame, form a gap between the second upper notch and the small-diameter one of the center portion and the other end portion of the shaft on an upper side of the small-diameter one, the second upper notch having a diameter larger than that of the small-diameter one, so that the second upper support member does not contact the small-diameter one.

2. The shaft packaging body according to claim 1, wherein a thickness of at least one of the first lower support member, the second lower support member, the first upper support member and the second upper support member is different from those of the other support members.

3. The shaft packaging body according to claim 1, wherein the first upper support member and the second upper support member are inserted to respective positions below an upper surface of the partitioning frame.

4. The shaft packaging body according to claim 1, comprising:

a sheet material provided between adjacent partitioning frames when a plurality of the partitioning frames is stacked in a plurality of tiers; and an exterior material covering the plurality of partitioning frames and the plurality of sheet materials from a side when a plurality of the sheet materials and the plurality of frames are stacked in tiers to accommodate a plurality of shafts, the exterior material having a height that is smaller than a total of respective heights of the plurality of sheet materials and respective heights of the plurality of partitioning frames.

* * * * *